US009089012B2

(12) United States Patent
McDougle

(10) Patent No.: US 9,089,012 B2
(45) Date of Patent: Jul. 21, 2015

(54) SECONDARY-SIDE SENSING OF PHASE-DIMMING SIGNAL

(71) Applicant: Anthony N. McDougle, Lafayette, CO (US)

(72) Inventor: Anthony N. McDougle, Lafayette, CO (US)

(73) Assignee: TERRALUX, INC., Longmont, CO (US)

( * ) Notice: Subject to any disclaimer, the term of this patent is extended or adjusted under 35 U.S.C. 154(b) by 176 days.

(21) Appl. No.: 13/902,137

(22) Filed: May 24, 2013

(65) Prior Publication Data

US 2014/0346967 A1 Nov. 27, 2014

(51) Int. Cl.
*H05B 37/02* (2006.01)

(52) U.S. Cl.
CPC ..... *H05B 37/02* (2013.01)

(58) Field of Classification Search
USPC ..... 315/209 R, 276, 291, 297, 307, 308
See application file for complete search history.

(56) References Cited

U.S. PATENT DOCUMENTS

| | | | | |
|---|---|---|---|---|
| 7,759,881 | B1 | 7/2010 | Melanson | |
| 8,080,819 | B2 | 12/2011 | Mueller et al. | |
| 8,093,820 | B1 | 1/2012 | Stevens | |
| 8,344,657 | B2 * | 1/2013 | Zhan et al. | 315/302 |
| 8,358,090 | B1 | 1/2013 | Mednik et al. | |
| 8,384,305 | B2 | 2/2013 | Liao et al. | |
| 2011/0304270 | A1 | 12/2011 | Scarpelli | |
| 2012/0206064 | A1 | 8/2012 | Archenhold | |
| 2012/0249005 | A1 | 10/2012 | Jin et al. | |
| 2012/0319615 | A1 | 12/2012 | Lee et al. | |
| 2013/0002156 | A1 | 1/2013 | Melanson et al. | |

FOREIGN PATENT DOCUMENTS

| | | | |
|---|---|---|---|
| WO | WO-2009147563 | A2 | 12/2009 |
| WO | WO-2011042510 | A2 | 4/2011 |
| WO | WO-2011045057 | A1 | 4/2011 |
| WO | WO-2011045372 | A1 | 4/2011 |
| WO | 2014/190260 | A1 | 11/2014 |

OTHER PUBLICATIONS

PCT International Application No. PCT/US2014/039337, International Search Report and Written Opinion mailed Oct. 1, 2014, 13 pages.

* cited by examiner

*Primary Examiner* — Jimmy Vu
(74) *Attorney, Agent, or Firm* — Morgan, Lewis & Bockius LLP

(57) ABSTRACT

Current is regulated in an LED lamp by sensing, in a manner electrically isolated from a primary side of a transformer, an LED current in an LED; creating a digital control signal based on the LED current; transmitting the digital control signal from the secondary side of the LED circuit to the primary side; and controlling power delivered to the primary side based at least in part on the transmitted digital control signal.

15 Claims, 3 Drawing Sheets

SECONDARY-SIDE SENSING OF PHASE-DIMMING SIGNAL

TECHNICAL FIELD

Embodiments of the current invention relate to lighting systems and, more specifically, to light-emitting diode ("LED") driver circuits.

BACKGROUND

LED light sources are attractive alternatives to traditional incandescent, fluorescent, or halogen lamps because of their high light output and low power consumption. LED lamps, however, require specialized driver and/or control circuits in order to properly supply power to the LEDs (typically, via a regulated current) using traditional power sources (e.g., an AC line voltage). As a further constraint, safety standards created by organizations such as UL and CE require that hazardous voltages (e.g., voltages above approximately 50 volts) must be isolated from users.

A popular LED driver circuit that fulfills these requirements uses a flyback converter, which applies the input voltage to a primary side of a flyback transformer (i.e., a charge-storing transformer) to induce a current therein. A switch periodically shuts off the application of the input voltage, during which time the flyback transformer discharges its stored charge as a current through its secondary side. This secondary-side current is used to drive the LEDs. As an added benefit, the separation between the primary and secondary sides of the flyback transformer provides the electrical isolation required by the safety standards.

Because the LED drive current requires regulation, however, the flyback-converter circuit must also sense any variations in the secondary-side current and adjust the power delivered to the primary side of the flyback transformer accordingly. For example, if the secondary-side current is too low, the primary-side control circuit may increase the amount of time per cycle that the switch is on and thereby apply more input power to the primary side. The sensed secondary-side LED current must be therefore transmitted back to the primary side, and it must be done while preserving the primary/secondary electrical isolation.

An existing circuit 100 for feeding back the sensed LED current to the primary side of the circuit is shown in FIG. 1. An input line voltage 102 is applied to a filter and rectifier 104 and thereafter to a primary side 106 of a flyback transformer 108. A primary-side control circuit 110 periodically shuts off a transistor switch 112, at which time the secondary side 114 applies a current to the LEDs 116 (through a rectifier diode 118 and a filter capacitor 120). A current-sense circuit 122 senses the current through the LEDs 116 and sends a corresponding sensing signal through an opto-isolator 118. The opto-isolator 118 passes the signal across the isolation barrier using a light-emitting diode and a photodiode, thereby preserving the electrical isolation. The primary-side control circuit 110 receives the feedback signal from the opto-isolator 118 and adjusts the switching time of the switch 112 accordingly.

There are a number of drawbacks to the use of the opto-isolator 118, however. The accuracy of the current regulation depends on the quality of the analog signal passed therethrough; if the opto-isolator 118 is poorly calibrated, out of specification, and/or changes or degrades over time, the light produced by the LEDs 116 may undesirably vary and/or the lifespan of the LEDs 116 may shorten. These issues may be mitigated (but not eliminated) by the use of a higher-quality opto-isolator 118, but the higher cost of such a component may be undesirable or prohibitive.

The shortcomings of the use of the opto-isolator 118 are exacerbated if the LEDs 116 are to be used with a dimming signal. Any errors introduced into the feedback signal by the opto-isolator 118 produce erratic, inconsistent, or time-varying levels of light output by the LEDs 116 for a given dimmer setting. Furthermore, if one dimmer signal is used to control multiple LED lamps, differences in each of the opto-isolators in each lamp may produce different levels of output light from each lamp.

A need therefore exists for an LED lamp driver circuit that complies with safety standards while providing accurate and consistent current regulation and dimming control.

SUMMARY

In general, various aspects of the systems and methods described herein include a control circuit disposed on the secondary side of an LED driver transformer. The secondary-side control circuit samples the LED drive current and generates a digital control signal, which is transmitted back to the primary side. A switching circuit on the primary side receives the digital control signal and adjust current delivered to the primary accordingly. The secondary-side control circuit may also receive one or more dimming signals and/or sense the use of an upstream dimming signal and adjust the digital control signal accordingly.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. In the following description, various embodiments of the present invention are described with reference to the following drawings, in which.

DETAILED DESCRIPTION

Described herein are various embodiments of methods and systems for accurately biasing and dimming one or more LEDs while complying with electrical isolation requirements mandated by safety organizations. A control circuit on the secondary side of a transformer senses one or more currents in the LEDs and determines whether the LED drive current requires adjustment. The secondary-side control circuit sends a digital control signal back to the primary side based on this determination through an opto-isolator. Because the current sense and regulation control occurs on the secondary side, the feedback signal need not contain the precise analog measurement of the LED current, but only a digital control value (encoded, for example, as a modulated signal such as a pulsewidth modulation ("PWM") signal or other data carrier). Thus, errors in the accuracy of the opto-isolator (i.e., fluctuations in its ability to translate analog values across the isolation barrier) do not affect the accuracy of the regulation. In various embodiments, the secondary-side control circuit receives one or more dimming signals on the secondary side of the transformer. The secondary-side control circuit adjusts the digital feedback signal in accordance with dimming information received in the dimming signals, thereby causing the LEDs to be dimmed accordingly. In other embodiments, a downstream dimming unit modifies a phase of the input voltage to the primary side; the secondary-side control circuit senses this modification and adjusts the digital control signal accordingly.

Figure 1:
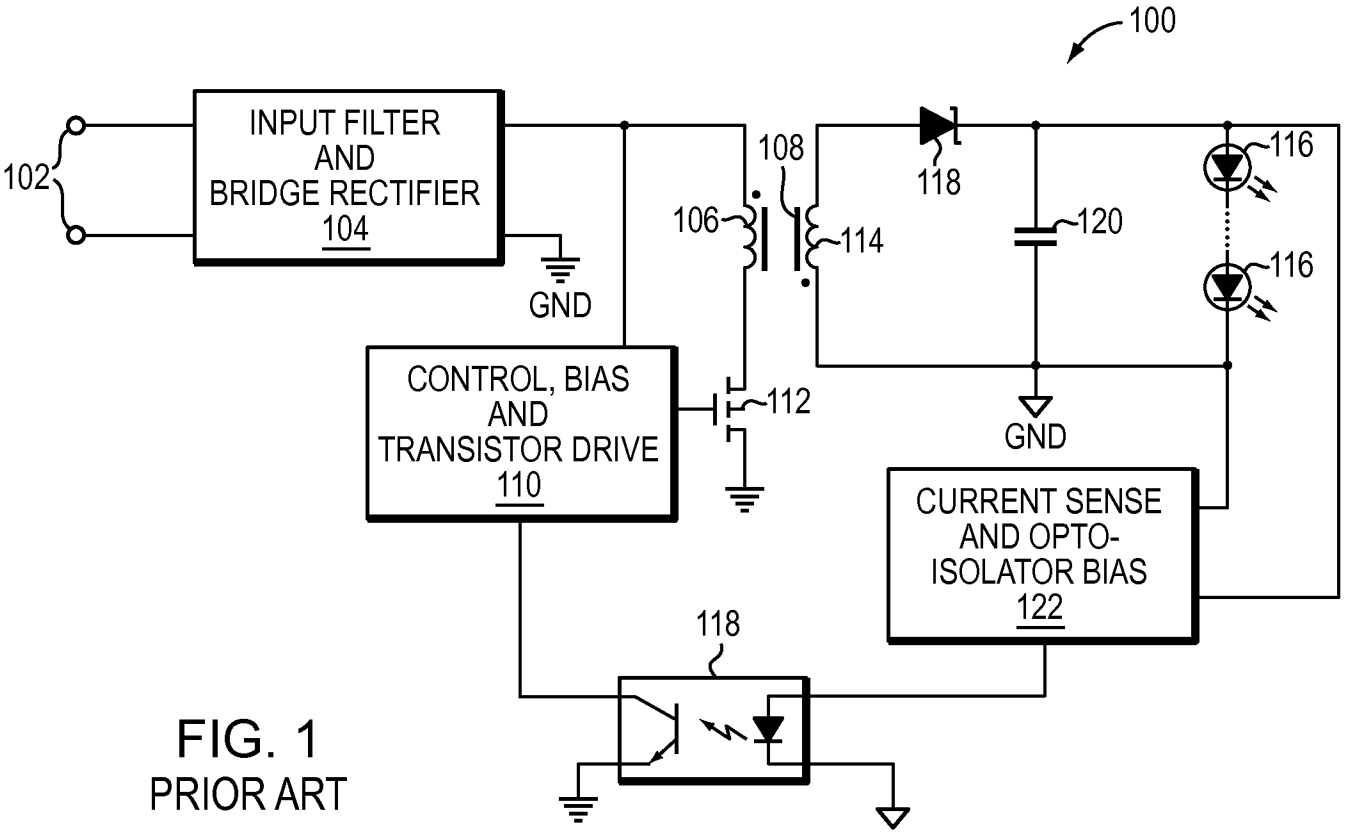
FIG. 1 PRIOR ART
FIG. 1 illustrates an existing system for driving an LED with a flyback converter.
Figure 2:
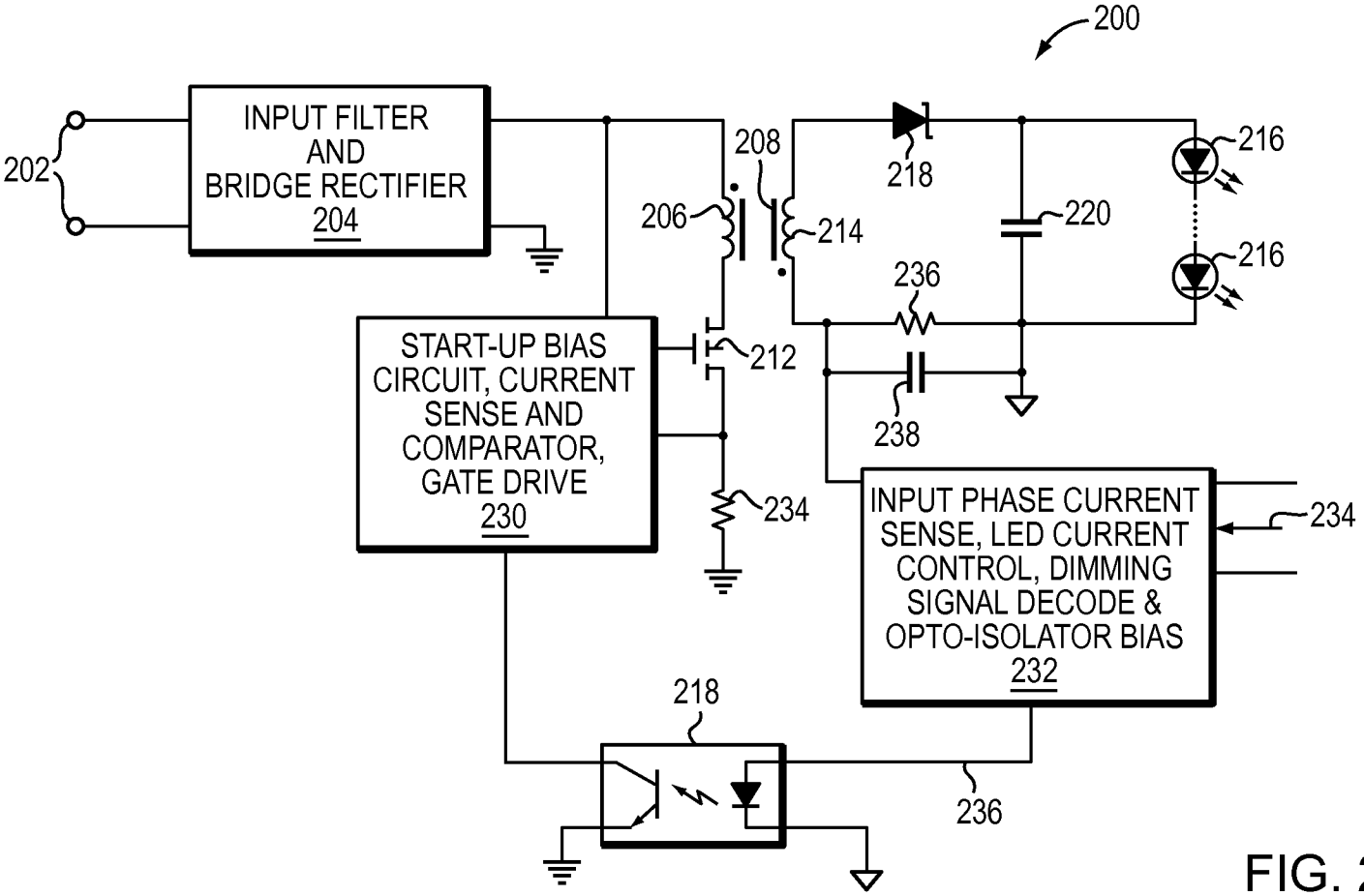
FIG. 2 illustrates a system for sensing and controlling LED driver current, and controlling dimming, on the secondary side of a transformer in accordance with embodiments of the present invention.

One embodiment of a circuit 200 for secondary-side control of LEDs is illustrated in FIG. 2. A secondary-side control circuit 232 includes a current-sensing circuit for sensing a drive current in one or more LEDs 216. The current-sensing circuit may be analog or digital and operates in accordance with any method known in the art. In one embodiment, the current-sensing circuit includes a resistor 236 for converting the current to a voltage and a capacitor 238 for filtering the converted voltage. A current-control circuit analyzes the sensed current and generates a digital control signal 236 in response. In various embodiments, the current-control circuit compares the sensed current to an analog or digital reference and generates a data signal encoding the difference; for purposes of illustration and not limitation, the ensuing discussion assumes PWM encoding. For example, if the sensed current is too low, the PWM signal may be adjusted to have longer pulses (i.e., the PWM signal has a longer duty cycle) and if the sensed current is too high, the PWM signal is adjusted to have shorter pulses. If the sensed current is equal to (or within a range of tolerance with respect to) the reference, the current-control circuit makes no change to the PWM carrier signal.

An opto-isolator 218 transmits the digital control signal 236 across the primary/secondary side isolation barrier to the primary side of the transformer 208. Because the control signal is digital, the absolute value of the digital signal (i.e., its potential difference relative to a reference or ground) does not affect the operation of the circuit 200, and thus variations in the operation, performance, or tolerance of the opto-isolator 218 do not affect the operation of the circuit 200. In other embodiments, a small-signal transformer (or any other isolating, signal-transmitting component) is used in place of the opto-isolator 218.

A switching circuit 230 receives the primary-side version of the digital control signal via the opto-isolator 218 and switches a transistor switch 212 on and off accordingly, thereby regulating the power delivered to the primary side 206 of the transformer 208. The switching circuit 230 may include a current-sense circuit for sensing current across a resistor 234 and a comparator for comparing the sensed current to the received digital signal.

In various embodiments, the circuit 200 adjusts the light emitted by the LEDs 216 in response to various types of dimming signals. In one embodiment, the dimming of the LEDs 216 is controlled by one or more dimming signals 234 input to the circuit 200, such as signals conforming to the 0-10 V lighting control protocol or to the digital-addressable lighting interface ("DALI") protocol. These signals may require electrical isolation from a high-voltage source (e.g., the input voltage 202) as a part of their specifications. The input dimming-control signals 234 may therefore be received by the secondary-side control circuit 232, which is electrically isolated from the primary side of the circuit 200. In one embodiment, the secondary-side control circuit 232 adjusts the digital control signal in accordance with both the current sensed in the LEDs 216 and the received dimming control signals.

In another embodiment, the LEDs 216 are dimmed by a dimmer circuit upstream of the circuit 200 by changing the input power signal 202. For example, a phase-based dimming circuit may adjust (i.e., "chop") the phase of the input power signal 202 before it arrives at the input filter and rectifier 204. When the phase dimmer chops the input voltage 202, the current in the primary side 206 of the transformer 208 drops; the resulting dropping current in the secondary side 214 is detected by the secondary-side sensing circuit 232, which adjusts the digital control signal accordingly. In one embodiment, the dropping secondary-side current causes a falling edge in the voltage across the resistor 236; the secondary-side sensing circuit 232 detects the falling edge, converts the falling edge into a phase measurement (e.g., how much of the phase of the input voltage 202 was chopped by the phase dimmer) and adjusts the digital control signal accordingly to increase or decrease the drive current in the LEDs 216.

Figure 3:
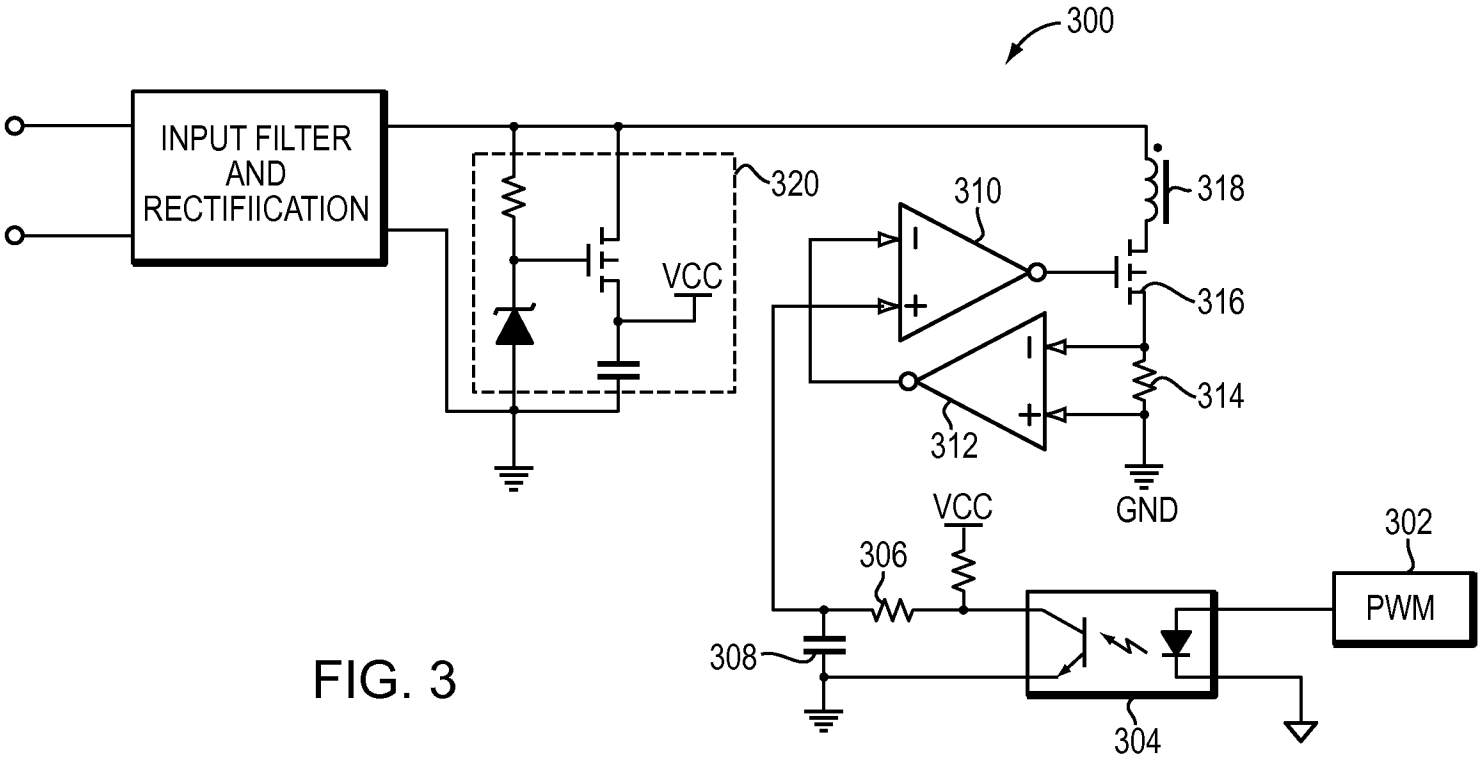
FIG. 3 illustrates an exemplary primary-side circuit in accordance with embodiments of the present invention.

One implementation of a primary-side circuit 300 is illustrated in FIG. 3. The secondary-side control circuit generates a PWM signal 302, which is transmitted to the primary side of the circuit 300 by an opto-isolator 304. A low-pass filter (including a resistor 306 and a capacitor 308) filters the received PWM signal to smooth it into a signal more suitable for driving the LEDs 216. The filtered PWM signal is compared, using a first comparator 310, to a reference signal generated by a current sensor (which includes a second comparator 312 and a current-sensing resistor 314). The output of the first comparator 310 drives a hysteretic-gate driver 316, thereby controlling current in the transformer primary 318. A startup circuit 320 may be used to ensure that the transformer starts in a discontinuous conduction mode; in this mode, the input impedance of the transformer is dominated by a resistive characteristic (which ensures the input current and input voltage are both sinusoidal and in phase).

The secondary-side sensing circuit 232 may be implemented using any components or methods known in the art. In one embodiment, a microcontroller, ASIC, or other digital-logic circuit or processor may be used to generate the digital control signal 236 based on the sensed LED current, received dimming signal 234, and/or sensed phase-dimming signal. In one embodiment, the secondary-side sensing circuit 232 determines the type of the dimming signal (e.g., phase, 0-10 V, or DALI). The LEDs 216 may be controlled by more than one type of dimming signal; for example, a manual dimming controller may use phase dimming and an automatic dimming controller (which, for example, dims the LEDs 216 if a room in which the LEDs 216 are disposed is unoccupied for a certain amount of time, or based on sensed ambient light) may use DALI dimming. The secondary-side sensing circuit 232 may blend or sum the different types of dimming (i.e., cause the LEDs 216 to dim to an amount determined by both dimming controllers) or dim the LEDs 216 based on only one type of dimming in accordance with a pre-programmed or user-input precedence. The order of precedence, dimming-signal detection information, and any other information necessary for the implementation of the secondary-side sensing circuit 232 may be stored in an included volatile or non-volatile memory (e.g., RAM, ROM, flash, firmware, or other such circuitry or device).

The circuit 200 may be modified to reduce its cost (at the expense of accuracy) or to increase accuracy (by increasing its cost). A low-cost version of the circuit 200 may include a small output capacitor 220 (or no output capacitor 200 at all). A medium-cost version of the circuit 200 may reduce ripples or other noise in the LED drive current by increasing the size of the output capacitor 220. A high-performance version of the circuit 200 may add an additional converter stage (making the circuit 200 a two-stage converter).

Certain embodiments of the present invention were described above. It is, however, expressly noted that the present invention is not limited to those embodiments, but rather the intention is that additions and modifications to what was expressly described herein are also included within the scope of the invention. Moreover, it is to be understood that the features of the various embodiments described herein were not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

What is claimed is:

1. A system for regulating current in an LED lamp, the system comprising:

a control circuit in electrical communication with a secondary side of a transformer and electrically isolated from a primary side of a transformer, the control circuit comprising:

i. a current-sense circuit for sensing an LED current in an LED; and ii. a current-control circuit for creating, based on the LED current, a digital control signal;

an isolation element for transmitting the digital control signal from the secondary side to the primary side without electrically bridging the primary and secondary sides; and a switching circuit for controlling power delivered to the primary side based at least in part on the transmitted digital control signal.

2. The system of claim 1, wherein the control circuit further comprises a dimming-signal decode circuit for decoding a received dimming signal, and wherein the current-control circuit creates the digital control signal further based on the received dimming signal.

3. The system of claim 2, wherein the dimming signal is at least one of a phase-dimming signal, a 0-10 V dimming signal, or a DALI dimming signal.

4. The system of claim 2, wherein the dimming signal comprises two or more of a phase-dimming signal, a 0-10 V dimming signal, and a DALI dimming signal, and wherein the dimming-signal decode circuit is configured to select one of the two or more signals in accordance with an order of precedence.

5. The system of claim 1, wherein the current-sense circuit further senses a change in the LED current created by a phase-dimming controller, the current-control circuit creating the digital control signal based also on the sensed change.

6. The system of claim 1, wherein the isolation element comprises an opto-isolator or a small-signal transformer.

7. The system of claim 1, further comprising a startup circuit for starting the transformer in a discontinuous conduction mode.

8. The system of claim 1, wherein the digital control signal comprises a PWM signal.

9. The system of claim 8, wherein the switching circuit filters the PWM signal and drives a transistor gate with the filtered signal.

10. A method for regulating current in an LED lamp driven by a circuit including a primary side of a transformer electrically isolated from a secondary side of the transformer, the method comprising:

sensing an LED current in an LED on the secondary side of the circuit;

creating, using the control circuit, a digital control signal based on the LED current;

transmitting the digital control signal from the secondary side to the primary side without electrically bridging the primary and secondary sides; and controlling power delivered to the primary side based at least in part on the transmitted digital control signal.

11. The method of claim 10, wherein creating the digital control signal is further based on a received dimming signal.

12. The method of claim 11, wherein the dimming signal is one or more of a phase-dimming signal, a 0-10 V dimming signal, or a DALI dimming signal.

13. The method of claim 11, wherein the dimming signal comprises two or more of a phase-dimming signal, a 0-10 V dimming signal, and a DALI dimming signal, and further comprising selecting one of the two or more signals in accordance with an order of precedence.

14. The method of claim 10, further comprising sensing a change in the LED current created by a phase-dimming controller, the digital control signal being based also on the sensed change.

15. The method of claim 10, further comprising starting the transformer in a discontinuous conduction mode.

* * * * *